United States Patent [19]

Steiner

[11] 4,050,480

[45] Sept. 27, 1977

[54] APPARATUS FOR SELECTIVE MOVING OF LAMELLA SHAPED HEDDLES

[75] Inventor: Alois Steiner, Rieden, Switzerland

[73] Assignee: Ruti Machinery Works Ltd., Ruti, Switzerland

[21] Appl. No.: 674,128

[22] Filed: Apr. 6, 1976

[30] Foreign Application Priority Data

June 6, 1975 Switzerland ..... 7328/75

[51] Int. Cl.[2] ..... D03C 13/00; D03D 47/26

[52] U.S. Cl. ..... 139/55.1; 139/455; 139/436

[58] Field of Search ..... 139/55 R, 55 A, 55 B, 139/59, 436, 319, 55.1, 455, 456

[56] References Cited

U.S. PATENT DOCUMENTS

| | | | |
|---|---|---|---|
| 2,845,093 | 7/1958 | Dietzsch et al. | 139/436 |
| 3,103,953 | 9/1963 | Lauritsen | 139/55 A |
| 3,147,774 | 9/1964 | Fontaine | 139/55 R |
| 3,640,314 | 2/1972 | Strauss | 139/55 R |

FOREIGN PATENT DOCUMENTS

| | | | |
|---|---|---|---|
| 1,024,897 | 2/1958 | Germany | 139/436 |
| 2,407,729 | 4/1975 | Germany | 139/55 A |

*Primary Examiner*—James Kee Chi

*Attorney, Agent, or Firm*—Donald D. Denton

[57] ABSTRACT

An apparatus for selective movement of individual lamella shaped heddles for the formation of a shed on a loom in which the heddles are positioned between flat guide elements with each heddle being selectively movable to one of two predetermined different positions.

16 Claims, 5 Drawing Figures

APPARATUS FOR SELECTIVE MOVING OF LAMELLA SHAPED HEDDLES

BACKGROUND OF THE INVENTION

The present invention relates to an apparatus for the selective moving of individual lamella shaped heddles or lamellae in order to form the shed on a loom in which the heddles arranged between flat guide elements and are movable between the latter in order to form the shed.

The jacquard machines known today have been, for the major part, of substantially the same type for a long time. A program stored on a punched card is noted by feeler needles. Depending on whether the feeler needle finds a hole in front of it or not, a corresponding hook is or is not grasped whereby desired warp threads are moved with simultaneous increase in force or not moved. The binding to the warp threads is effected in this connection by means of the so-called harness cords and heddles fastened to them.

These known arrangements have substantial drawbacks: The jacquard machine must be constructed on a frame above the loom; a harness having a large number of harness cords must be provided between the jacquard machine and the loom; the heddles must be subjected to a continuous downward pull by means of weights or elastic cords; and the speed of operation of these machines is relatively slow.

SUMMARY OF THE INVENTION

The above disadvantages are avoided by the apparatus of the present invention. The invention is characterized by the fact that between adjacent guide elements there is a space the size of which permits two predetermined different positions for each of the lamella shaped heddles; that means are provided to place each of the heddles selectively in one or the other predetermined position; and that for each heddle there is a drive means by which the heddle is carried along in its one predetermined position and which releases this heddle in its other predetermined position.

Although the present invention is intended on the one hand for traveling wave looms, it is however suitable for other weaving processes which operate with a single shed which extends over the entire width of the loom, as is true for instance in the conventional weaving looms.

BRIEF DESCRIPTION OF THE DRAWINGS

The invention will be described in further detail on basis of illustrative examples of the mechanism for selective moving of heddles with reference to the drawings, in which.

DESCRIPTION OF PREFERRED EMBODIMENTS

Figure 1:
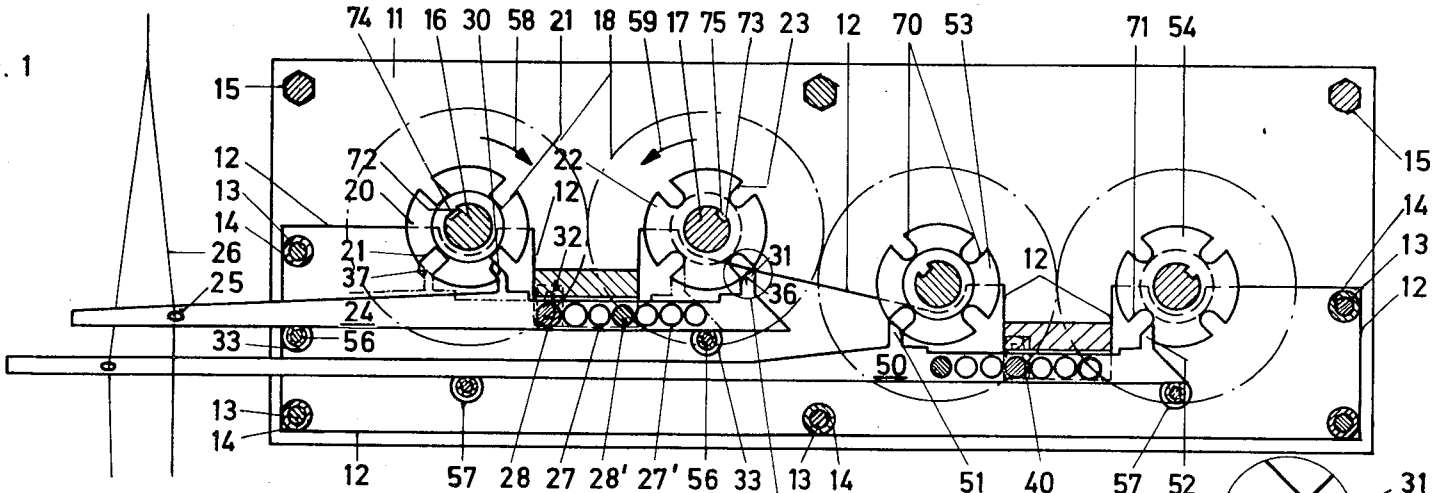
FIG. 1 is a cross-sectional view through one embodiment of the present invention.

In the drawings identical parts have been provided with the same reference numbers.

Figure 2:
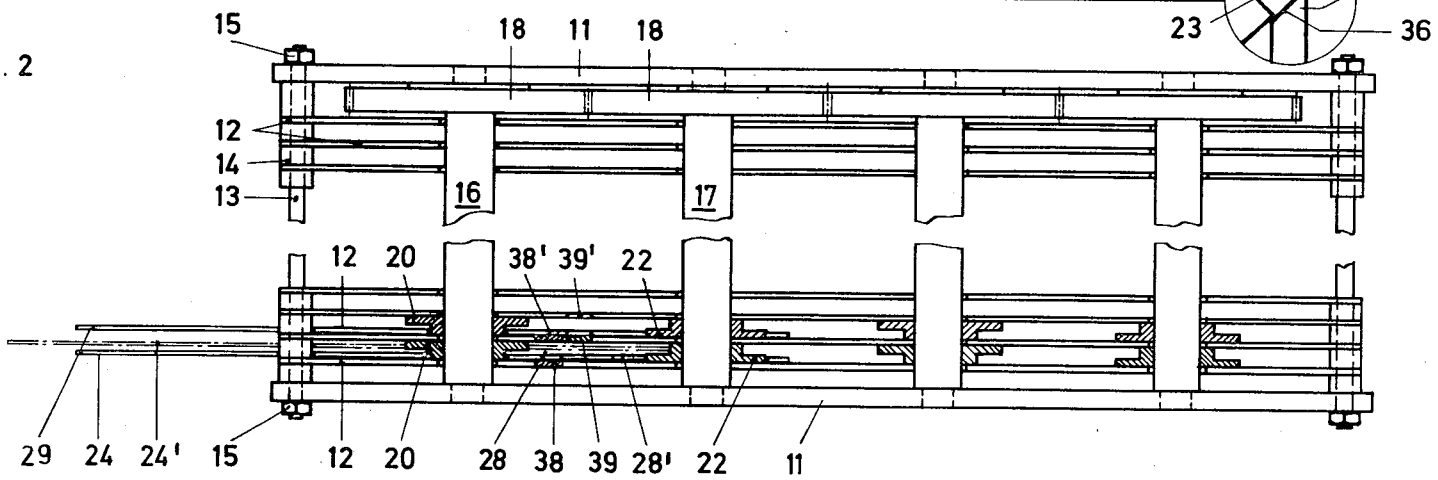
FIG. 2 is a top view of the embodiment shown in FIG. 1.

Referring to FIGS. 1 and 2, a plurality of guide elements 12 are provided between two end walls 11. In order to make their shape clear, the reference number 12 has been provided in FIG. 1 at different points of the contour of the guide element. the guide elements 12 are borne by the rods 13 and are held at precisely determined distances apart by means of the spacer washers 14. The rods 13 and nuts 15 serve to combine the end walls 11 and the guide elements 12 into a single unit. The shafts 16, 17 driven via the gears 18 are supported in the end walls 11.

The shaft 16 bears a plurality of first disks 20 which form heddle driving means, and which are provided with notches or driving elements 21; and the shaft 17 bears a plurality of second disks 22 which form heddle driving means, and which disks are provided with notches 23. Between two given adjacent guide elements 12 there are located both a first disk 20 and a second disk 22, the first disk 20 directly adjoining the one guide element 12 and the second disk 22 directly adjoining the other guide element 12.

Between every two adjacent guide elements 12 there is a lamella shaped heddle or 24 having eye 25. Through the eye 25 of each heddle a warp thread 26 is drawn and in order to form the web the said warp thread is moved by a movement of the heddle 24 corresponding to the pattern to be woven into its upper shed or lower shed position.

Each heddle 24 has a number of openings 27. In every two of them there is inserted a permanent magnet 28, 28' each of which is magnetized. The magnetization is such that the right-hand half of each magnet forms one pole and the left-hand half of each magnet forms the other pole. Each heddle 24 is provided with two driving members 30, 31 developed as and defining nose-shaped projections, the driving member 30 cooperating with the driving elements 21, developed as notches, of the first disk 20 and the driving member 31 cooperating with the driving elements 23, developed as notches, of the second disk 22. An electromagnet system or means 32 is furthermore provided. When the heddle 24 is at its one end position upon the formation of the shed, the one permanent magnet 28 is aligned with the electromagnet system 32 while in the other end position of the lamella 24 the other magnet 28' is aligned with the electromagnet 32. Each electromagnet 32 has a front and a rear horseshoe-shaped piece of iron 38 and 38' around which a coil is wound so that the legs of each magnet 38, 38' can be magnetized selectively as north pole or south pole depending on the direction of a current which flows through the coil.

Figure 3:
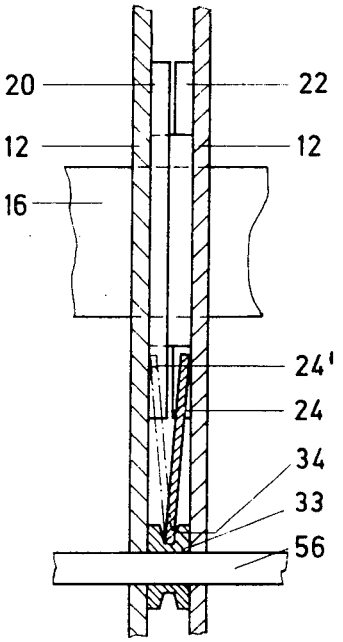
FIG. 3 is a partial view showing the arrangement of a heddle seen in the direction from the warp threads.

Details as to the manner of the support of the heddle 24 between the guide elements 12 can be noted from FIG. 3. Between the guide elements 12 there is provided a support which consists of a linear groove or of small wheels 33 provided with annular grooves 34. The one longitudinal edge of the heddle 24 rests in the annular grooves 34 of the wheels 33. It can assume two predetermined, different positions. In one of these positions the heddle 24, shown in FIG. 3, rests against the right-hand guide element 12 while in the other predetermined position 24' the heddle, as indicated in dashed line, rests against the left-hand guide element 12. The support 33 can for instance consist of a strip provided with a groove. In the example shown in the drawing it consists of the rollers 33 which are rotatably supported on the shafts 56. The rollers 33 permit easy displacement of the heddle 24 in their longitudinal direction.

Upon the operation of the loom and thus of the device shown in FIGS. 1 and 2 of the drawings, the shafts 16, 17 and the first and second disks 20, 22 respectively connected with them are continuously in rotation in the direction of rotation indicated by the arrows 58, 59. The heddle 24 is in the forward tilted (to the right of FIG. 3) position shown in the drawing. In this condition the edge 36 of the driving member 31 rests against the outer circumference of the second disk 22 since the heddle 24 is subjected by the warp thread 26 to a pull towards the left. This condition is shown more clearly in the enlargment to which the reference line refers.

If the heddle 24 is now to be moved to the left in the upper-shed position, then the magnet system 32 is actuated in such a manner that the permanent magnet 28 and thus the heddle 24 is pressed around its lower longitudinal edge against the rear (left in FIG. 3) guide element 12. The driving member 30 thus enters into the first driving element 21 which is moving past the member 30 while the driving member 31 is lifted from the outer circumference of the disk 22 and moves towards the rear. The driving element 21 now moves the driving member 30 and thus the heddle 24 towards the left into a position which is indicated by the dot-dash driving members. In this way the warp thread 26 comes into the upper shed position. As a result of the tension of the warp thread 26, the edge 37 of the member 30 rests now against the outer circumference of the disk 20.

In this connection the inaccurate application of the member 30 to the circumference of the disk 20 during the movement of the heddle 24 ias avoided since the member 31 is between the disk 22 and the rear (left in FIG. 3) guide element 12 during the movement of the heddle 24. Furthermore, in the meantime the magnet system 32 has again been deactivated. The magnet 28' which has now moved to the place of this arrangement 32 is closer to the rear half of the magnet system 32, i.e. the rear horseshoe-shaped iron piece 38'. Furthermore the member 31 remains behind the disk 22. Thus the heddle 24 remains in this predetermined position and the forward tilting of the heddle 24 is avoided.

If the heddle 24 is to be again moved to the right into the low-shed position, the magnet system 32 is again fed an electric current from the programmed control source means. As a result the heddle 24 is tilted forward (to the right in FIG. 3) as soon as the driving member 31 engages in a driving element 23. By this tilting process the driving member 30 moves laterally away from the outer circumference of the disk 20. It comes into the space between the latter and the front guide element 12, so that the heddle 24 in its forward tilted position is moved back again into the position shown in FIG. 1 by a driving element 23 of the disk 22 by means of the cam 31. In this position the edge 36 rests against the outer circumference of the disk 22 since the heddle 24 is urged towards the left by the warp thread 26. The driving member 30 located between disk 20 and the front guide element 12, as well as the attraction between magnet 28 and the front half 38 of the unactivated magnet system or means 32 cause the stability of the forward tilted lamella 24.

It may here be pointed out in particular that even when the apparatus or loom is shut off, the 24 remains in its tilted position. In the longitudinal direction of the heddle 24, the latter is subjected continuously to a force as a result of the tensioned warp thread 26. A lateral tilting of the heddle 24 is avoided by the fact that the disk 20 or 22 prevents the driving member 30 or 31 from moving away from the guide element 12 against which it rests or is tilted. Furthermore, the permanent magnet 28 or 28' is attracted more strongly to that horseshoe iron piece 38 or 38' against which it is tilted than it is attracted to the one away from which it is tilted.

In general, the driving members 30 and 31 have the same shape but a position which is turned 180° away with respect to a vertical line. In FIG. 1 therefore only two different forms are shown in order to indicate the possibility of different shapes. The same applies also to the first and second driving elements 21 and 23. In connection with the latter, it must be borne in mind of course that the notches forming these elements always leave sufficient space for the members 30 and 31 in order to permit the driving of the latter without any jamming.

It is necessary to see to it that no undesired effects on the adjacent lamellae are produced by the magnet systems. For this purpose they are displaced with respect to each other in the longitudinal direction of the heddles, as can be noted from FIG. 2 in connection with the magnet systems 38, 38' and 39, 39'. In corresponding manner, in the case of the heddles 29 corresponding to the arrangement 39, 39', the engaged magnets are engaged in those openings 27 which are displaced one opening each towards the right with respect to the magnets 28, 28' of the heddle 24. Of course it is also possible to jump by more than merely the adjacent opening 27 from one heddle 24 to the next heddle 29.

For clarity in description, the lateral distances between the guide elements 12 and thus the heddles 24, 29 have been shown exaggerated in FIG. 2. In actuality there must be expected a distance between adjacent heddles 24, 29 of about 2 mm. For an average or close count of the warp threads such a distance is too large. In order to remedy this disadvantage, a second and third row of heddles can further be provided in different levels. One such second row is represented in FIG. 1 by the heddles 50. In each case an upper heddle 24 and a lower heddle 50 are arranged between the same guide elements 12. The heddles 50 in their turn have driving members 51, 52 which are actuated by disks 53, 54 by means of first and second driving elements 70, 71 respectively. The heddles 50 are supported and guided on rollers 57. The row of the upper heddles 24 forms a first level and the row of the lower heddles 50 forms a second level. As a result of the distance between the two levels the magnet arrangement 40 and the disks 53, 54 are displaced downward a corresponding amount. The manner of operation however is precisely the same as that of the lamellae 24 and disks 20, 22 heretofore described, so that further description would be merely a repetition and is therefore not given.

Figure 4:
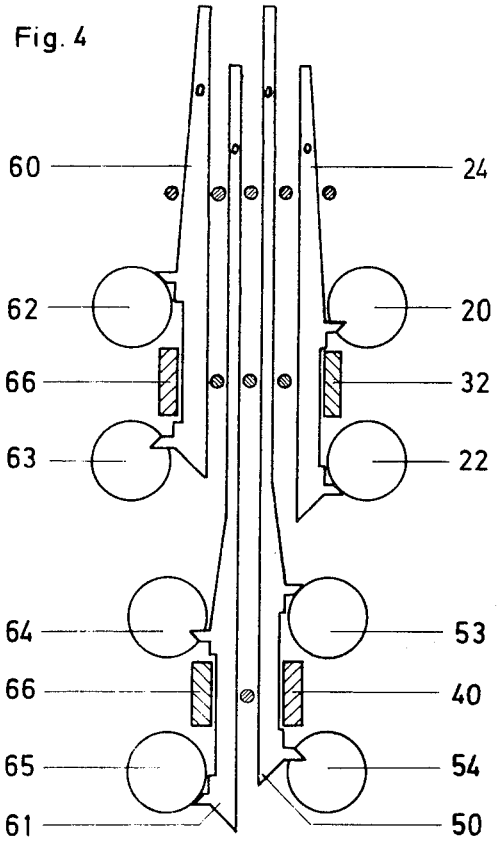
FIG. 4 is a diagrammatic showing of one example with a large number of heddles.

Another doubling of the number of the heddles is obtained by, starting from the arrangement shown in FIG. 1, providing in addition to the levels of the heddles 24 and 50 also a third and a fourth level of heddles, as shown in FIG. 4. As mirror images to the levels of the heddles 24, 50 two further levels of heddles 60 and 61 are provided. In the same manner, the disks 62, 63, 64, 65 are arranged as mirror images to the disks 20, 22, 53, 54 and the magnet arrangements 66 are arranged as mirror images to the magnet arrangements 32, 40. FIG.

4 shows that the heddles need not lie horizontally but can also be used in, for instance, a vertical arrangement.

When the heddles 24, 50 extend at their front end by such an amount in longitudinal direction that they permanently extend out of the shed they can, as shown in the drawing, operate as heddles which directly guide the warp threads.

Figure 5:
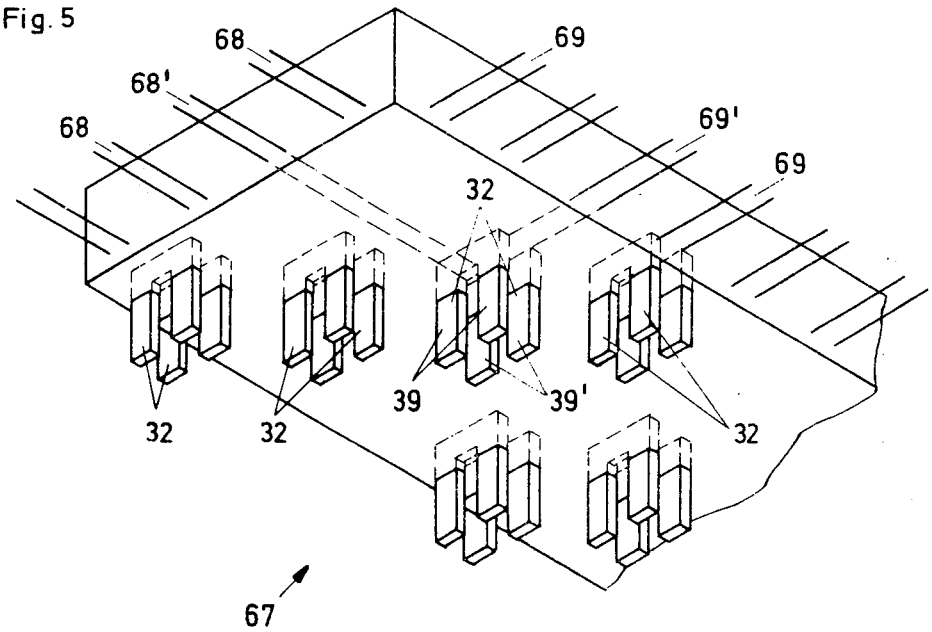
FIG. 5 is a view in perspective of a means which serves for the displacing of heddles into their predetermined positions.

One possible embodiment of the magnet arrangement 32 consists in the magnet arrangements which are in the same alignment or else all of the magnet arrangements which belong to one level of lamellae being combined into a unit. As example of such an embodiment four rows of two double magnets each are shown in FIG. 5. This figure is a bottom view and shows only a part of the unit. All magnets are encapsulated in a block 67 of plastic, the arms of the magnets protruding out of the block 67. Furthermore, there are also present electric wires 68 encapsulated in the block 67, each of which connects the magnet arrangements 32 lying in a line.

Each of the wires perpendicular to the wires 68 forms an electric connection with one of the magnet arrangements 32. The wires 68 and 69 lead to windings (not shown) which serve to magnetize the horseshoe magnets 32. If for example a source of current from the programmed control source means is connected to the wires 68' and 69', a flow of current is produced which energizes the magnets 39, 30'.

For the sake of completeness it may furthermore be mentioned that each heddle 24, instead of being provided with two permanent magnets 28, may be provided with only a single one. In such case however instead of one magnet arrangement 32 two thereof are necessary for each heddle 24, and an actuatable magnet arrangement must be present at the positions of the permanent magnet corresponding to the open shed and bottom shed positions.

It is clear that the lateral tilting of the heddles means a movement of a small mass by a small distance. Furthermore, the arrangement of the permanent and electromagnets is extremely compact. From this there result the advantages that only small forces are necessary for the control and that the control can take place very rapidly.

When using the individual heddle control in accordance with the present invention on an undulated loom, the individual heddles 24 and 50 must be moved one after the otherover the width of the loom. In order to achieve this, the disks 20, 22; 53, 54 are displaced at an angle continuously with respect to each other along the shafts 16, 17. In this connection it is advantageous to block the displacement by means of the grooves 72, 73 (see FIG. 1). This can be done for instance in the manner that in the case of straight grooves 72, 73, i.e. grooves parallel to the axes of rotation, the wedge noses 74, 75 of the disks 20, 22 are displaced by small angular amounts from each disk to the next.

A quarter of a revolution of a driving element 21, 23 moves a warp thread from the low-shed position into the high-shed position, or vice versa. In the case of an undulated loom, in the one position of the warp thread one shuttle passes this warp thread and in the other position the next shuttle passes. If four driving members 21, 23 are present on a disk 20, 22 then the driving elements 21, 23 are displaced and (sic) 90° over a length which corresponds to the distance between two adjacent shuttles. If *n* driving elements are distributed at regular intervals over the disks, then the driving elements corresponding to each other lie along a helical line the pitch of which (complete revolution of 360°) is equal to *n* times the distance between adjacent filling thread introduction members.

It is advisable to effect the control of the heddles in the manner that the pulse for the tilting of the heddles 24 commences in the operating phase in which a driving element is located directly in front of the engagement position for the driving member, as is true in FIG. 1 for the disk 20. The actuating pulses for the magnetic systems lying in a row must therefore be staggered in time, in the case of an undulated loom, corresponding to the helical course of the driving elements.

It will be appreciated that various changes and/or modifications may be made within the skill of the art without departing from the spirit and scope of the invention illustrated, described, and claimed herein.

What is claimed is:

1. An apparatus for selective movement of individual lamella shaped heddles for the formation of a shed on a loom, in which the heddles are arranged between flat guide elements and are movable between them to form the shed, the apparatus comprising adjacent guide elements having a space therebetween the size of which permits two predetermined different lateral positions for each of the heddles; means provided to displace each heddle selectively into one of the two predetermined lateral positions, and for each heddle a drive means so provided by which the heddle is driven in one direction when displaced in one of the predetermined positions and in the opposite direction when displaced in the other predetermined position.

2. The apparatus according to claim 1 in which the drive means extends in the space between adjacent guide elements and acts on the heddle in its longitudinal direction, the drive means is located in each space on the side of one of the adjacent guide elements, and in the one predetermined position the heddle rests against one guide element and in the other predetermined position it rests against the other guide element so that the heddle in one of the predetermined positions is outside the sphere of action of the drive means.

3. The apparatus according to claim 1 in which the heddles are provided at their front end with means for operatively positioning the warp threads into the desired shed position during movement of the heddles.

4. The apparatus according to claim 2 in which one longitudinal edge of each heddle is contained in a groove located between adjacent guide elements and the heddle can be tilted around this one longitudinal edge.

5. The apparatus according to claim 2 in which the drive means comprises a plurality of rotatable disks arranged alongside of each other, each of which is inserted in a space between two adjacent guide elements, and has at least two driving elements distributed uniformly over the circumference of each rotatable disk, and each disk is associated with one of the heddles, each heddle having a driving member which is developed to operatively cooperate with a driving element.

6. The apparatus according to claim 2 in which each of the heddles has at least one permanent magnet and the said one permanent magnet is in coincidence in the upper and lower shed positions with a controllable magnet arrangement, the said magnet arrangement being magnetizable to produce the selective attraction or repulsion of the said permanent magnet in order to displace the heddle alternately into one or the other of the predetermined positions.

7. The apparatus according to claim 4 in which each heddle lies in the groove which is formed by at least two small wheels, each having an annular groove, and the wheels are rotatable on shafts borne by the guide elements.

8. The apparatus according to claim 5 on an undulated loom in which the introduction of the filling threads is effected by a plurality of filling thread introduction members passing simultaneously at a given distance apart through the warp threads, in which the rotatable disks are arranged on a common shaft and are angularly displaced from each other in the manner that the driving elements lie along helical lines the pitch of which is equal to *n* times the distance between successive filling thread introduction members, *n* being equal to the number of driving elements present on a rotatable disk.

9. The apparatus according to claim 5 in which each of the driving elements defines a notch extending inwards from the outer periphery of the disk, each said disk on its one side directly adjoins the one guide element, said drive member of the heddle formed by a projection insertable into the notches, said projection on the resting of the heddle against the one guide element extending in the plane defined by the disk.

10. The apparatus according to claim 5 in which each heddle has two driving members arranged at a distance apart in their longitudinal direction, and for each heddle two disks rotating in opposite direction are provided which are arranged at a distance apart in the longitudinal direction of the lamellae which is adapted to the distance apart of the driving members, each driving member associated with a disk, one side of the one disk directly adjoining the one guide element and the one side of the other disk directly adjoining the other guide element, and the distance of the other sides of the disks from the non-adjoining guide elements being greater than the thickness of the drive members.

11. The apparatus according to claim 5 in which the heddles form at least two levels located one above the other, said heddles of different levels located between identical adjacent guide elements and said heddles of each level arranged alongside of each other and separated from each other by the guide elements, and rotating disks with drive elements are associated with each level of heddles, the disks associated with different levels of heddles being staggered with respect to each other in the longitudinal direction of the heddles and in the direction of the different levels.

12. The apparatus according to claim 6 in which the controllable magnet arrangement is provided and each of the heddles has two permanent magnets and is in coincidence in the high-shed position of the one permanent magnet and in the low-shed position of the other permanent magnet with the controllable magnet arrangement, and the latter is controllably magnetizable for the selective attraction or repulsion of the permanent magnet which is in each case in coincidence, in order to displace the heddle selectively into one or the other of the predetermined positions.

13. The apparatus according to claim 6 in which the controllable magnet arrangements associated with adjacent heddles are displaced with respect to each other in the longitudinal direction of the heddles and the heddles have means for the fastening of permanent magnets at all places which, when the heddles are in the upper shed and lower shed positions, can come into coincidence with a controllable magnet arrangement.

14. The apparatus according to claim 6 in which at least the magnet arrangements lying in the same alignment are combined into a unit which is arranged transverse to the guide elements.

15. The apparatus according to claim 9 in which the projection is provided with an edge which extends parallel to the outer circumference of the disk.

16. The apparatus according to claim 11 in which the heddles of at least two levels lying one above the other and the associated rotating disks are arranged as mirror images opposite each other.

* * * * *